US010557092B2

(12) United States Patent
Calla et al.

(10) Patent No.: US 10,557,092 B2
(45) Date of Patent: Feb. 11, 2020

(54) RAFFINATE HYDROCONVERSION FOR PRODUCTION OF HIGH PERFORMANCE BASE STOCKS

(71) Applicant: ExxonMobil Research and Engineering Company, Annandale, NJ (US)

(72) Inventors: Jason T. Calla, Raritan, NJ (US); Will G. Fisher, Jr., Houston, TX (US); Eric D. Joseck, Spring, TX (US); Seth D. Fortney, Spring, TX (US)

(73) Assignee: ExxonMobil Research and Engineering Company, Annadale, NJ (US)

( * ) Notice: Subject to any disclaimer, the term of this patent is extended or adjusted under 35 U.S.C. 154(b) by 179 days.

(21) Appl. No.: 15/643,893

(22) Filed: Jul. 7, 2017

(65) Prior Publication Data

US 2018/0037829 A1 Feb. 8, 2018

Related U.S. Application Data

(60) Provisional application No. 62/370,361, filed on Aug. 3, 2016.

(51) Int. Cl.
*C10G 65/12* (2006.01)
*C10G 67/04* (2006.01)
(Continued)

(52) U.S. Cl.
CPC ..... *C10G 65/12* (2013.01); *C10G 45/54* (2013.01); *C10G 65/043* (2013.01); *C10G 65/08* (2013.01);
(Continued)

(58) Field of Classification Search
CPC ..... C10G 65/12; C10G 45/54; C10G 65/043; C10G 65/08; C10G 67/0436; C10G 67/0445; C10G 67/04; C10G 2400/10
See application file for complete search history.

(56) References Cited

U.S. PATENT DOCUMENTS 5,358,627 A 10/1994 Mears et al.
5,935,416 A 8/1999 Cody et al.
(Continued)

FOREIGN PATENT DOCUMENTS

EP 2835417 A1 2/2015
WO 2004053034 A1 6/2004

OTHER PUBLICATIONS

The International Search Report and Written Opinion of PCT/US2017/041079 dated Sep. 18, 2017.

*Primary Examiner* — Randy Boyer
*Assistant Examiner* — Juan C Valencia
(74) *Attorney, Agent, or Firm* — Robert A. Migliorini; Scott F. Yarnell

(57) ABSTRACT

Systems and methods are provided for production of base stocks with a viscosity index of at least 120 and/or a sulfur content of 300 wppm or less and/or a kinematic viscosity at 100° C. of 3.0 cSt to 8.0 cSt by hydroconversion of a raffinate from aromatic extraction of a feed. The base stocks can further have a reduced content of 3+ ring naphthenes, such as 4.0 wt % or less, or 1.0 wt % or less. The base stocks can be produced by performing an elevated amount of feed conversion relative to 370° C. during hydroconversion of the raffinate, and optionally additional conversion during catalytic dewaxing of the hydroconverted raffinate. The base stocks can optionally be blended with additional base stocks and/or lubricant additives for production of lubricant compositions.

30 Claims, 5 Drawing Sheets

(51) Int. Cl.
*C10G 45/54* (2006.01)
*C10G 65/04* (2006.01)
*C10G 65/08* (2006.01)

(52) U.S. Cl.
CPC ..... *C10G 67/04* (2013.01); *C10G 67/0436* (2013.01); *C10G 67/0445* (2013.01); *C10G 2400/10* (2013.01)

(56) References Cited

U.S. PATENT DOCUMENTS

| | | | | |
|---|---|---|---|---|
| 6,325,918 | B1 | 12/2001 | Cody et al. | |
| 6,592,748 | B2 * | 7/2003 | Cody | C10G 65/04 208/133 |
| 6,602,402 | B1 | 8/2003 | Benazzi et al. | |
| 7,282,137 | B2 | 10/2007 | Cody et al. | |
| 7,704,930 | B2 | 4/2010 | Deckman et al. | |
| 8,394,255 | B2 | 3/2013 | McCarthy et al. | |
| 2002/0189972 | A1 | 12/2002 | Benazzi et al. | |
| 2006/0289337 | A1 | 12/2006 | Rosenbaum et al. | |
| 2007/0135666 | A1 | 6/2007 | Koivusalmi et al. | |
| 2009/0014354 | A1 | 1/2009 | Knuuttila et al. | |
| 2009/0088352 | A1 | 4/2009 | Zakarian et al. | |
| 2012/0000829 | A1 * | 1/2012 | Dougherty | C10G 21/003 208/264 |
| 2014/0042056 | A1 * | 2/2014 | Daage | C10G 65/12 208/60 |
| 2014/0262944 | A1 | 9/2014 | Kim et al. | |

* cited by examiner

RAFFINATE HYDROCONVERSION FOR PRODUCTION OF HIGH PERFORMANCE BASE STOCKS

CROSS-REFERENCE TO RELATED APPLICATIONS

This application claims priority to U.S. Provisional Application Ser. No. 62/370,361 filed Aug. 3, 2016, which is herein incorporated by reference in its entirety.

FIELD

Systems and methods are provided for production of lubricant oil base stocks using a raffinate hydroconversion process.

BACKGROUND

Lubricant base stocks are one of the higher value products that can be generated from a crude oil or crude oil fraction. The ability to generate lubricant base stocks of a desired quality is often constrained by the availability of a suitable feedstock. For example, most conventional processes for lubricant base stock production involve starting with a crude fraction that has not been previously processed under severe conditions, such as a virgin gas oil fraction from a crude with moderate to low levels of initial sulfur content.

One of the challenges in producing lubricant base stocks can be to generate a desirable yield of high performance base stocks, such as Group III base stocks, Group II heavy neutral base stocks, and/or Group II bright stocks. Conventionally, catalytic hydroprocessing can be used to generate lubricant base stocks with a high viscosity index, but the yield of base stocks with heavy neutral or brightstock viscosity can tend to be reduced or minimized. Conventionally, solvent processing can be used to generate lubricant base stocks with a high viscosity, but such base stocks produced by solvent processing can tend to correspond to Group I base stocks.

U.S. Pat. No. 6,592,748 describes methods for raffinate hydroprocessing. A lubricant boiling range feed, such as a light or medium neutral vacuum distillate feed, is solvent extracted. The raffinate from solvent extraction is then mildly hydroconverted and dewaxed. Production of Group II base stocks having various viscosities is described, such as viscosities up to about 7 cSt at 100° C.

U.S. Pat. No. 8,394,255 describes methods for forming lubricant base stocks using catalytic hydroprocessing. The methods include performing dewaxing under sour conditions during base stock production.

SUMMARY

In various aspects, systems and methods are provided for production of base stocks with a viscosity index of at least 120 and/or a sulfur content of 300 wppm or less and/or a kinematic viscosity at 100° C. of 3.0 cSt to 8.0 cSt by hydroconversion of a raffinate from aromatic extraction of a feed. The base stocks can further have a reduced content of 3+ ring naphthenes, such as 4.0 wt % or less, or 1.0 wt % or less. The base stocks can be produced by performing an elevated amount of feed conversion relative to 370° C. during hydroconversion of the raffinate, and optionally additional conversion during catalytic dewaxing of the hydroconverted raffinate. The base stocks can optionally be blended with additional base stocks or lubricant additives for production of lubricant compositions.

DETAILED DESCRIPTION

Figure 1:
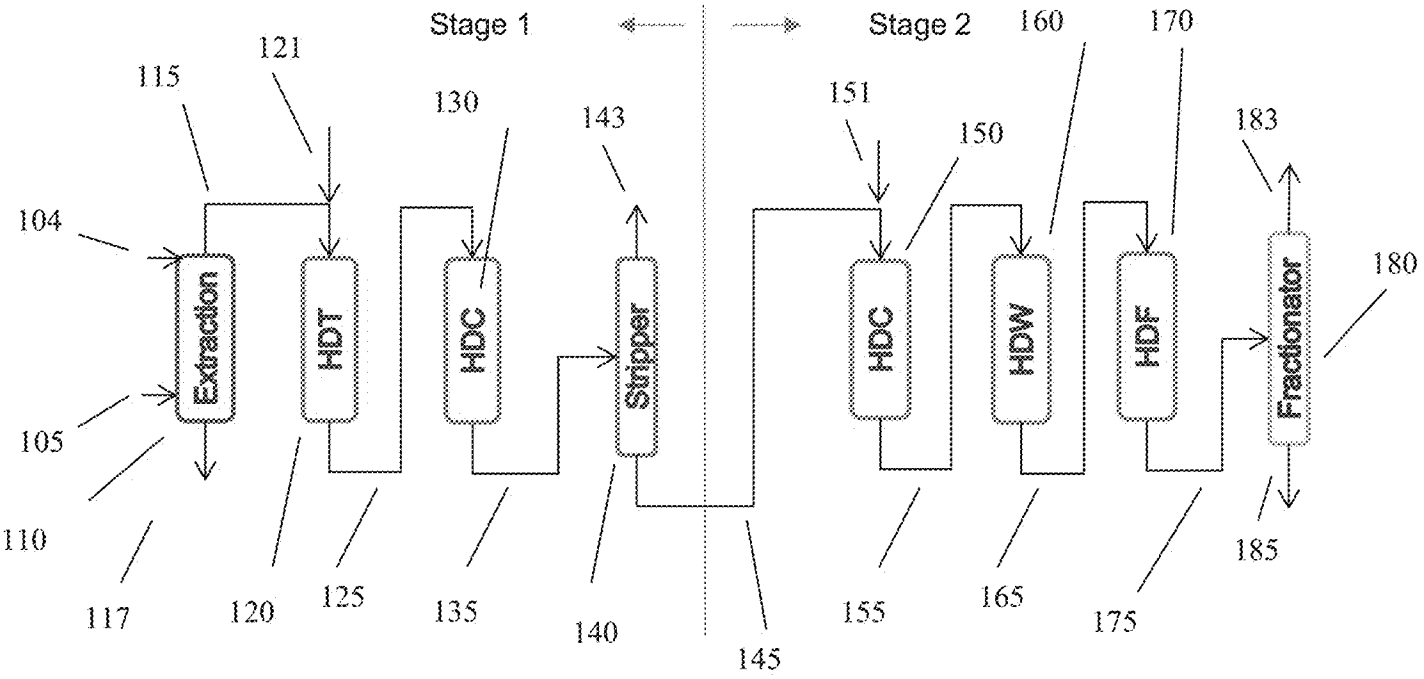
FIG. 1 schematically shows an example of a configuration for processing a feedstock form a lubricant base stock.

All numerical values within the detailed description and the claims herein are modified by "about" or "approximately" the indicated value, and take into account experimental error and variations that would be expected by a person having ordinary skill in the art.

Overview

In various aspects, systems and methods are provided for producing Group III base stocks using a raffinate hydroconversion process. The Group III base stocks can be produced in part by selecting raffinate hydroconversion conditions that correspond to conditions for high conversion relative to 370° C. It has been unexpectedly found that high conversion conditions can allow for production of Group III base stocks from the solvent extraction raffinate of a lubricant boiling range feed. The high conversion can be achieved using hydrotreating, hydrocracking, or a combination thereof. In aspects where hydrocracking is used as part of hydroconversion, the hydrocracking can be performed under sour conditions, sweet conditions, or some portions of the hydrocracking can be performed under sour conditions while other portions of the hydrocracking are performed under sweet conditions. After raffinate hydroconversion, the hydroconverted effluent can be catalytically dewaxed and/or hydrofinished.

Additionally or alternately, in some aspects systems and methods are provided for producing high viscosity Group II base stocks using a raffinate hydroconversion process, such as Group II base stocks having a viscosity of at least 7.0 cSt at 100° C., such as at least 9.0 cSt or at least 12 cSt. The Group II base stocks can be produced using hydrotreating, hydrocracking, or a combination thereof. In aspects where hydrocracking is used as part of hydroconversion, the hydrocracking can be performed under sour conditions, sweet conditions, or some portions of the hydrocracking can be performed under sour conditions while other portions of the hydrocracking are performed under sweet conditions. After raffinate hydroconversion, the hydroconverted effluent can be catalytically dewaxed and/or hydrofinished. The process for production of Group II base stocks having a high viscosity can otherwise be similar to the processes described, for example, in U.S. Pat. No. 6,592,748.

Conventionally, raffinate hydroconversion can provide a method for producing Group II lubricant base stocks by using a combination of solvent extraction and hydroconversion of the raffinate to provide a desired level of VI uplift. By performing some VI uplift using both solvent extraction and subsequent hydroconversion, a Group II base stock can be produced that has volatility properties similar to a Group III base stock. However, using high activity catalysts for the hydroconversion to produce Group II base stocks can lead to substantially reductions in yield. In order to reduce or minimize such yield reductions, low activity catalysts can typically be used, so that a conventional hydroconversion process can be performed at a 370° C.+ conversion of about 15 wt % or less while still providing a desired level of uplift for production of Group II base stocks.

In various aspects, instead of operating at 15 wt % conversion or less, a raffinate hydroconversion process can be operated at 30 wt % conversion or more, such as 40 wt % conversion or more. This can allow for production of Group III lubricant base stocks with one or more unexpected properties.

Group I base stocks or base oils are defined as base stocks with less than 90 wt % saturated molecules and/or at least 0.03 wt % sulfur content. Group I base stocks also have a viscosity index (VI) of at least 80 but less than 120. Group II base stocks or base oils contain at least 90 wt % saturated molecules and less than 0.03 wt % sulfur. Group II base stocks also have a viscosity index of at least 80 but less than 120. Group III base stocks or base oils contain at least 90 wt % saturated molecules and less than 0.03 wt % sulfur, with a viscosity index of at least 120.

In some aspects, a Group III base stock as described herein may correspond to a Group III+ base stock. Although a generally accepted definition is not available, a Group III+ base stock can generally correspond to a base stock that satisfies the requirements for a Group III base stock while also having at least one property that is enhanced relative to a Group III specification. The enhanced property can correspond to, for example, having a viscosity index that is substantially greater than the required specification of 120, such as a Group III base stock having a VI of at least 130, or at least 135, or at least 140. Similarly, in some aspects, a Group II base stock as described herein may correspond to a Group II+ base stock. Although a generally accepted definition is not available, a Group II+ base stock can generally correspond to a base stock that satisfies the requirements for a Group II base stock while also having at least one property that is enhanced relative to a Group II specification. The enhanced property can correspond to, for example, having a viscosity index that is substantially greater than the required specification of 80, such as a Group II base stock having a VI of at least 103, or at least 108, or at least 113.

In the discussion below, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In this discussion, unless otherwise specified a lubricant boiling range fraction corresponds to a fraction having an initial boiling point or alternatively a T5 boiling point of at least 370° C. (~700° F.). A distillate fuel boiling range fraction, such as a diesel product fraction, corresponds to a fraction having a boiling range from 193° C. (375° F.) to 370° C. (~700° F.). Thus, distillate fuel product fractions can have initial boiling points (or alternatively T5 boiling points) of at least 193° C. and final boiling points (or alternatively T95 boiling points) of 370° C. or less. A naphtha boiling range fraction corresponds to a fraction having a boiling range from 36° C. (122° F.) to 193° C. (375° F.). Thus, naphtha fuel product fractions can have initial boiling points (or alternatively T5 boiling points) of at least 36° C. and final boiling points (or alternatively T95 boiling points) of 193° C. or less. It is noted that 36° C. roughly corresponds to a boiling point for the various isomers of a $C_5$ alkane. Light ends are defined as products with boiling points below 36° C., which include various $C_1$-$C_4$ compounds. When determining a boiling point or a boiling range for a feed or product fraction, an appropriate ASTM test method can be used, such as the procedures described in ASTM D2887, D2892, D6352, D7129, and/or D86.

CONFIGURATION EXAMPLES

FIG. 1 shows an example of a configuration suitable for production of lubricant base stocks via raffinate hydroconversion. In FIG. 1, a feed 105 corresponding to a desired fraction (based, for example, on boiling range and/or viscosity) is passed into a solvent extraction unit 110 along with solvent 104. The feed 105 can correspond to a fraction from a vacuum fractionator or another suitable separation stage. The solvent extraction unit 110 can produce an aromatics-enriched extract fraction 117 and a raffinate 115. In FIG. 1, raffinate 115 is passed into a hydrotreater 120 (or one or more hydrotreaters 120) along with hydrogen 121. Although hydrogen 121 is shown as being added to the raffinate 115, it is understood that hydrogen can be added at other convenient locations in the process flow, including prior to any stage to provide supplemental hydrogen and/or after any stage to assist with quenching of an effluent. In some aspects, hydrotreater 120 can be optional. In FIG. 1, hydrotreated effluent 125 is cascaded into sour hydrocracker 130 (or one or more sour hydrocrackers 130). In some aspects, sour hydrocracker 130 can be optional. In aspects where sour hydrocracker 130 is present, hydrotreated effluent 125 can be passed through an optional separation stage prior to entering sour hydrocracker 130.

The effluent from sour hydrocracker 130 (or the effluent from hydrotreater 120 if sour hydrocracker 130 is not present) can then be passed into a separation stage. In FIG. 1, the separation stage is represented by a stripper 140. Stripper 140 can allow for formation of a first fraction 143 corresponding to diesel, naphtha, and light ends boiling range compounds and a second fraction 145 corresponding to heavier compounds (i.e., including lubricant boiling range compounds). Alternatively, a portion of the fuels boiling range compounds can be included in the second fraction 145. In some aspects, stripper 140 can be replaced and/or used as part of a separation stage. A separation stage can include any convenient number of strippers, flash separators, and/or fractionators to allow for production of desired fractions.

After stripper 140, the sulfur content of the second fraction 145 can be low enough to allow subsequent processes to be performed under "sweet" conditions. The second fraction 145 can be passed into an optional sweet hydrocracker 150 (or one or more sweet hydrocrackers 150) along with hydrogen 151. The hydrocracked effluent 155 or the second fraction 145 can then be cascaded or otherwise passed into reactors for additional processing. FIG. 1 shows one option, where hydrocracked effluent 155 (or second fraction 145) is cascaded or otherwise passed into dewaxing reactor 160 (or one or more dewaxing reactors 160). The dewaxed effluent 165 can then be passed into hydrofinishing reactor 170 (or one or more hydrofinishing reactors 170). Hydrofinished effluent 175 can then be fractionated 180 to form one or more desired lubricant base stock fractions 185, and optionally one or more fuels fractions 183. Another option can be to pass hydrocracked effluent 155 (or second fraction 145) into hydrofinishing reactor 170 prior to dewaxing, with hydrofinishing effluent 175 being passed into dewaxing reactor 160. Still another option can be to include a hydrofinishing reactor both before and after dewaxing reactor 160. It is noted that for the configuration shown in FIG. 1, it may be convenient to replace reactors within a stage with catalyst beds in a single reactor. For example, it may be convenient to replace hydrotreating reactor 120 and hydrocracking reactor 130 with a single reactor containing bed(s) of hydrotreating and hydrocracking catalyst. Similarly, it may be convenient to replace dewaxing reactor 160 and hydrofinishing reactor 170 with a single reactor containing bed(s) of dewaxing and hydrofinishing catalyst.

Feedstocks

A wide range of petroleum and chemical feedstocks can be hydroprocessed in accordance with the disclosure. Suitable feedstocks include whole and reduced petroleum crudes, atmospheric resids, cycle oils, gas oils, including vacuum gas oils and coker gas oils, light to heavy distillates including raw virgin distillates, hydrotreated oils, slack waxes, Fischer-Tropsch waxes, and mixtures of these materials. In some aspects, a feedstock can correspond to a mineral feedstock, such as a feedstock comprising at least 50 wt % of feed derived from a mineral source, or at least 75 wt %, or at least 95 wt %.

One way of defining a feedstock is based on the boiling range of the feed. One option for defining a boiling range is to use an initial boiling point for a feed and/or a final boiling point for a feed. Another option is to characterize a feed based on the amount of the feed that boils at one or more temperatures. For example, a "T5" boiling point/distillation point for a feed is defined as the temperature at which 5 wt % of the feed will boil off. Similarly, a "T95" boiling point/distillation point is a temperature at 95 wt % of the feed will boil. Boiling points, including fractional weight boiling points, can be determined using a suitable ASTM method as described above.

Typical feeds include, for example, feeds with an initial boiling point and/or a T5 boiling point and/or T10 boiling point of at least 600° F. (~316° C.), or at least 650° F. (~343° C.), or at least 700° F. (371° C.), or at least 750° F. (~399° C.). Additionally or alternately, the final boiling point and/or T95 boiling point and/or T90 boiling point of the feed can be 1100° F. (~593° C.) or less, or 1050° F. (~566° C.) or less, or 1000° F. (~538° C.) or less, or 950° F. (~510° C.) or less. In particular, a feed can have a T5 to T95 boiling range of 600° F. (~316° C.) to 1100° F. (~593° C.), or a T5 to T95 boiling range of 650° F. (~343° C.) to 1050° F. (~566° C.), or a T10 to T90 boiling range of 650° F. (~343° C.) to 1050° F. (~566° C.)

In some aspects, the feed can have a sulfur content of 500 wppm to 40000 wppm or more, or 500 wppm to 20000 wppm, or 500 wppm to 5000 wppm. Additionally or alternately, the nitrogen content of such a feed can be 20 wppm to 4000 wppm, or 50 wppm to 2000 wppm. In some aspects, the feed can correspond to a "sweet" feed, so that the sulfur content of the feed is 10 wppm to 500 wppm and/or the nitrogen content is 1 wppm to 100 wppm.

In some aspects, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus Jatropha. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

In various aspects, a feedstock can have a boiling range and/or viscosity that is initially suitable for production of a base stock having a desired viscosity, or the feedstock can be separated (such as fractionated) to form a feed cut or fraction corresponding to a desired boiling range/viscosity range for the resulting base stock product. Typical (vacuum) gas oil cuts or fractions can include, for example, fractions with a T5 distillation point to T95 distillation point of 650° F. (343° C.)-1050° F. (566° C.), or 650° F. (343° C.)-1000° F. (538° C.), or 650° F. (343° C.)-950° F. (510° C.) or 650° F. (343° C.)-900° F. (482° C.) or 700° F. (370° C.)-1050° F. (566° C.) or 700° F. (370° C.)-1000° F. (538° C.) or 700° F. (370° C.)-950° F. (510° C.) or 700° F. (370° C.)-900° F. (482° C.) or 750° F. (399° C.)-1050° F. (566° C.), or 750° F. (399° C.)-1000° F. (538° C.), or 750° F. (399° C.)-950° F. (510° C.), or 750° F. (399° C.)-900° F. (482° C.). The desired boiling range can depend on the desired final viscosity of a base stock.

Solvent Extraction

Solvent extraction can be used to reduce the aromatics content and/or the amount of polar molecules. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Examples of typical feeds can include distillates from a vacuum or atmospheric distillation unit, preferably from a vacuum distillation unit, and may be of poor quality. The feeds may contain nitrogen and sulfur contaminants in excess of 1 wt. % based on feed.

Optionally, the raffinate from the solvent extraction can be under-extracted. This can correspond to lower severity extraction conditions that would typically be employed for production of a Group I base stock. In such aspects, the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. In various aspects, the raffinate yield from solvent extraction can be at least about 40 wt %, or at least about 50 wt %, or at least about 60 wt %, or at least about 70 wt %. The raffinate from the solvent extraction unit can be stripped of solvent and then sent to a first hydroconversion unit (zone) containing a hydroconversion catalyst. This raffinate feed to the first hydroconversion unit can have a solvent dewaxed viscosity index (at −18° C. pour point) of from 75 to 105, or 80 to 95, or 90 to 105. In particular, for formation of Group III base stocks, the raffinate can have a solvent dewaxed viscosity index (at −18° C. pour point) of 80 to 105, or 85 to 100, or 90 to 105. Solvent extraction can also produce an extract fraction that is enriched in aromatics.

In carrying out the extraction process, water may be added to certain extraction solvents (such as N-methyl pyrrolidone) in amounts ranging from 1 to 10 vol. % such that the extraction solvent to the extraction tower contains from 3-10 vol. % water, preferably 4 to 7 vol. % water. In general, feed to the extraction tower is added at the bottom of the tower and extraction/water solvent mixture added at the top and the feed and extraction solvent contacted in counter-current flow. The extraction solvent containing added water may be injected at different levels if the extraction tower contains multiple trays for solvent extraction. The use of added water in the extraction solvent permits the use of low quality feeds while maximizing the paraffin content of the raffinate and the 3+ multi-ring compounds content of the extract. Solvent extraction conditions include a solvent to oil ratio of from 0.5 to 5.0, preferably 1 to 3 and extraction temperatures of from 40 to 120° C., preferably 50 to 100° C.

If desired, the raffinate feed may be solvent dewaxed under solvent dewaxing conditions prior to entering the first hydroconversion zone. It may be advantageous to remove wax from the feed since very little, if any wax is converted in the hydroconversion units. This may assist in debottlenecking the hydroconversion units if throughput is a problem.

Hydrotreating and Hydrocracking

After solvent extraction, the raffinate (and any additional fractions combined with the raffinate) can undergo further processing to form lubricant base stocks. This can include hydrotreatment and/or hydrocracking to remove heteroatoms to desired levels and/or provide viscosity index (VI) uplift. Depending on the aspect, a raffinate can be hydroconverted by hydrotreating, hydrocracking, or hydrotreating and hydrocracking.

The reaction conditions during hydrotreatment and/or hydrocracking of the raffinate can be selected to generate a desired level of conversion of a feed. Conversion of the feed can be defined in terms of conversion of molecules that boil above a temperature threshold to molecules below that threshold. The conversion temperature can be any convenient temperature, such as 370° C. (~700° F.). The amount of conversion can correspond to the total conversion of molecules within the combined hydrotreatment and/or hydrocracking stages for the raffinate.

In aspects related to production of Group III base stocks, suitable amounts of conversion of molecules boiling above 370° C. (~700° F.) to molecules boiling below 370° C. (~700° F.) include 30 wt % to 60 wt % conversion relative to 370° C. (~700° F.), or 30 wt % to 50 wt %, or 40 wt % to 60 wt %, or 50 wt % to 60 wt %. The resulting hydroconverted raffinate (370° C.+ portion) produced by performing this amount of conversion can have a VI of at least 120, or at least 125, or at least 130. Additionally or alternately, the amount of increase in VI (370° C.+ portion) relative to the raffinate prior to hydroconversion can be at least 20, or at least 30, or at least 40.

In aspects related to production of Group II base stocks having a kinematic viscosity at 100° C. of at least 7.0 cSt, suitable amounts of conversion of molecules boiling above 370° C. (~700° F.) to molecules boiling below 370° C. (~700° F.) include 10 wt % to 30 wt % conversion relative to 370° C. (~700° F.), or 15 wt % to 30 wt %, or 15 wt % to 25 wt %. The resulting hydroconverted raffinate (370° C.+ portion) produced by performing this amount of conversion can have a VI of at least 95, or at least 100, or at least 105. Additionally or alternately, the amount of increase in VI (370° C.+ portion) relative to the raffinate prior to hydroconversion can be at least about 10, or at least about 15, or at least about 20, or at least about 30. In some aspects related to production of Group II base stocks, the VI of the raffinate prior to hydroconversion can be 75 to 90, or 75 to 85.

The hydroprocessed raffinate can also be characterized based on heteroatom content. After hydroprocessing (hydrotreating and/or hydrocracking in an initial sour stage), the hydroprocessed raffinate can have a sulfur content of 100 wppm or less, or 50 wppm or less, or 15 wppm or less, such as down to about 0 wppm. Additionally or alternately, the hydroprocessed raffinate (after hydrotreating and/or hydrocracking in an initial sour stage) can have a nitrogen content of 100 wppm or less, or 50 wppm or less, or 10 wppm or less, such as down to about 0 wppm.

In aspects where the reaction system includes a hydrotreating catalyst in the hydroconversion stage(s), the raffinate can be exposed to a hydrotreating catalyst under effective hydrotreating conditions. In some aspects, the desired level of conversion for production of Group III base stocks can be achieved during hydrotreatment without requiring hydrocracking. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania. Although weights are noted here in oxide form, during a hydrotreatment process, at least a portion of the Group VI and/or Group VIII metal(s) may be in a sulfide form.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain at least about 50 vol. % and more preferably at least about 75 vol. % hydrogen. Optionally, the hydrogen treat gas can be substantially free (less than 1 vol %) of impurities such as $H_2S$ and $NH_3$ and/or such impurities can be substantially removed from a treat gas prior to use.

Hydrotreating conditions can include temperatures of 200° C. to 450° C., or 315° C. to 425° C.; hydrogen partial pressures of 250 psia (1.8 MPa-a) to 5000 psia (34.6 MPa-a) or 300 psia (2.1 MPa-a) to 3000 psia (20.8 MPa-a); liquid hourly space velocities (LHSV) of 0.1 $hr^{-1}$ to 10 $hr^{-1}$; and hydrogen treat rates of 200 SCF/B (35.6 $m^3/m^3$) to 10,000 SCF/B (1781 $Nm^3/m^3$), or 500 SCF/B (89 $m^3/m^3$) to 10,000 SCF/B (1781 $m^3/m^3$).

In aspects where a hydrocracking catalyst is included in an initial sour stage or in a sweet stage after separation of impurities, the (optionally previously hydrotreated) feed can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. (In this discussion, the term "zeolite" is used broadly to refer to structures having a zeolite framework as recognized by the International Zeolite Association.) Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. It is noted that hydrocracking under sour conditions is typically performed using a base metal (or metals) as the hydrogenation metal.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed and/or present in the gas phase of the reaction environment. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. Feeds with sulfur contents of 250 wppm or more can be processed under sour conditions. Feeds with intermediate levels of sulfur can be processed either under sweet conditions or sour conditions.

A hydrocracking process under sour conditions can be carried out at temperatures of about 550° F. (288° C.) to about 840° F. (449° C.), hydrogen partial pressures of from about 1000 psia to about 5000 psia (~6.9 MPa-a to 34.6 MPa-a), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1000 psia to about 3000 psia (~6.9 MPa-a to 20.9 MPa-a), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the raffinate. A separator can then be used in between the first and second stages of the reaction system to remove gas phase sulfur and nitrogen contaminants. One option for the separator is to simply perform a gas-liquid separation to remove contaminants. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel boiling range is subjected to further hydroprocessing in a second hydroprocessing stage. The portion boiling above the distillate fuel boiling range can correspond to a lubricant boiling range fraction, such as a fraction having a T5 or T10 boiling point of at least about 343° C. Optionally, the lighter lube fractions can be distilled and operated in the catalyst dewaxing sections in a blocked operation where the conditions are adjusted to maximize the yield and properties of each lube cut.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 550° F. (288° C.) to about 840° F. (449° C.), hydrogen partial pressures of from about 1000 psia to about 5000 psia (~6.9 MPa-a to 34.6 MPa-a), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1000 psia to about 3000 psia (~6.9 MPa-a to 20.9 MPa-a), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1000 psia (~6.9 MPa-a). In such an aspect, other hydrocracking processes can be performed under conditions that may include lower hydrogen partial pressures. Suitable hydrocracking conditions for an additional hydrocracking stage can include, but are not limited to, temperatures of about 550° F. (288° C.) to about 840° F. (449° C.), hydrogen partial pressures of from about 250 psia to about 5000 psia (1.8 MPa-a to 34.6 MPa-a), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psia to about 3000 psia (3.5 MPa-a to 20.9 MPa-a), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

Catalytic Dewaxing and Hydrofinishing

After hydroconversion, at least a lubricant boiling range portion of the hydroconverted raffinate can be exposed to further hydroprocessing (including catalytic dewaxing) to form Group II and/or Group III base stocks.

For catalytic dewaxing, suitable dewaxing catalysts can include zeolites (as defined above, to include any structure corresponding to a framework recognized by the International Zeolite Association) and/or other molecular sieves such as crystalline aluminosilicates. In an embodiment, the zeolite can comprise, consist essentially of, or be ZSM-22, ZSM-23, ZSM-48. Optionally but preferably, zeolites that are selective for dewaxing by isomerization as opposed to cracking can be used, such as ZSM-48, ZSM-23, or a combination thereof. Additionally or alternately, the zeolite can comprise, consist essentially of, or be a 10-member ring 1-D molecular sieve, such as EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Optionally but preferably, the dewaxing catalyst can include a binder for the zeolite, such as alumina, titania, silica, silica-alumina, zirconia, or a combination thereof, for example alumina and/or titania or silica and/or zirconia and/or titania.

Preferably, the dewaxing catalyst can be a catalyst with a low ratio of silica to alumina. For example, for ZSM-48, the ratio of silica to alumina in the zeolite can be about 100:1 or less, such as about 90:1 or less, or about 75:1 or less, or about 70:1 or less. Additionally or alternately, the ratio of silica to alumina in the ZSM-48 can be at least about 50:1, such as at least about 60:1, or at least about 65:1.

In various aspects, the catalysts according to the disclosure can further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative aspect the metal hydrogenation component can be a combination of a non-noble Group VIII metal with a Group VI metal. Suitable alternative combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.5 wt %, or at least 1.0 wt %, or at least 2.5 wt %, or at least 5.0 wt %, based on catalyst. The amount of metal in the catalyst can be 20 wt % or less based on catalyst, or 10 wt % or less, or 5 wt % or less, or 2.5 wt % or less, or 1 wt % or less. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

A dewaxing catalyst can also include a binder. In some embodiments, the dewaxing catalyst can be formulated using a low surface area binder, a low surface area binder represents a binder with a surface area of 100 $m^2/g$ or less, or 80 $m^2/g$ or less, or 70 $m^2/g$ or less. Additionally or alternately, the binder can have a surface area of at least about 25 $m^2/g$. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Effective conditions for catalytic dewaxing of a feedstock in the presence of a dewaxing catalyst can include a temperature of from 300° C. to 450° C., preferably 343° C. to 435° C., a hydrogen partial pressure of from 3.5 MPa-a to 34.6 MPa-a (500 psia to 5000 psia), preferably 4.8 MPa-a to 20.8 MPa-a, and a hydrogen circulation rate of from 178 $m^3/m^3$ (1000 SCF/B) to 1781 $m^3/m^3$ (10,000 scf/B), preferably 213 $m^3/m^3$ (1200 SCF/B) to 1068 $m^3/m^3$ (6000 SCF/B). The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Although not included as part of the conversion during hydroconversion, the amount of conversion relative to 370° C. during catalytic dewaxing can also be characterized. For production of Group III base stocks, the amount of conversion during catalytic dewaxing can be at least 10 wt %, or at least 12 wt %. For production of Group II base stocks, the amount of conversion during catalytic dewaxing can be about 3 wt % to about 10 wt %, or about 4 wt % to about 8 wt %.

Before and/or after catalytic dewaxing, the hydroconverted raffinate (i.e., at least a lubricant boiling range portion thereof) can optionally be exposed to an aromatic saturation catalyst, which can alternatively be referred to as a hydrofinishing catalyst. Exposure to the aromatic saturation catalyst can occur either before or after fractionation. If aromatic saturation occurs after fractionation, the aromatic saturation can be performed on one or more portions of the fractionated product. Alternatively, the entire effluent from the last hydrocracking or dewaxing process can be hydrofinished and/or undergo aromatic saturation.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from about 125° C. to about 425° C., preferably about 180° C. to about 280° C., a hydrogen partial pressure from about 500 psia (3.4 MPa-a) to about 3000 psia (20.7 MPa-a), preferably about 1500 psia (10.3 MPa-a) to about 2500 psia (17.2 MPa-a), and liquid hourly space velocity from about 0.1 $hr^{-1}$ to about 5 $hr^{1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Group II and Group III Base Stock Products

The systems and methods described herein can allow for production of Group III base stocks. The Group III base stocks can correspond to base stocks derived from a mineral feed source, in contrast to polyalphaolefin base stocks and/or base stocks derived from Fischer-Tropsch synthesis. For Group III base stocks, the viscosity index can be at least 120, or at least 125, or at least 130, or at least 135. The pour point can be −9° C. or less, or −12° C. or less, or −15° C. or less. The Noack volatility can be about 15 wt % or less, or about 14 wt % or less, or about 13 wt % or less, or about 10 wt % or less, or about 8 wt % or less, or about 5 wt % or less. In particular, the Noack Volatility can be 3 wt % to 15 wt %, or 5 wt % to 15 wt %, or 5 wt % to 10 wt %, or 1 wt % to 5 wt %, or 3 wt % to 5 wt %, depending on the viscosity of the base stock. The kinematic viscosity at 100° C. can be 3.0 cSt to 8.0 cSt, or 3.5 cSt to 7.5 cSt, while the viscosity at 40° C. can be 15 cSt to 40 cSt. For example, in some aspects a base stock can have a kinematic viscosity at 100° C. of 3.0 cSt to 4.5 cSt, or 3.5 cSt to 4.5 cSt. In some aspects, a base stock can have a kinematic viscosity at 100° C. of 4.5 cSt to 8.0 cSt, or 5.0 cSt to 7.5 cSt, or 5.5 cSt to 7.5 cSt. Noack volatility can be determined, for example, according to ASTM D5800. Kinematic viscosity can be determined, for example, according to ASTM D445.

Additionally or alternately, the systems and methods described herein can allow for production of Group II base stocks. For Group II base stocks, the viscosity index can be at least 100, or at least 105, or at least 110. The viscosity at 100° C. can be at least 9.0 cSt, or at least 11.0 cSt, such as up to about 20 cSt or more, while the viscosity at 40° C. can be at least 80 cSt, or at least 100 cSt. The pour point can be −10° C. or less, or −15° C. or less. The Noack Volatility can be 5 wt % or less, or 3 wt % or less.

In addition to the above properties, Group III base stocks produced by the processes described herein can have a reduced or minimized content of 3+ ring naphthenes. In some aspects, the content of 3+ ring naphthenes can be less than 1.0 wt %, or less than 0.5 wt %, or less than 0.2 wt %. In some aspects related to a base stock having a kinematic viscosity at 100° C. of at least 4.5 cSt, or at least 5.0 cSt, or at least 5.5 cSt, the content of 3+ ring naphthenes can be less than 4.0 wt %, or less than 2.0 wt %, or less than 1.0 wt %. In addition to the above properties, Group II base stocks in certain embodiments of the present invention also have a reduced or minimized content of 3+ ring naphthenes. In some aspects, the content of 3+ ring naphthenes in the base stock is less than 6.0 wt %, or less than 5.0 wt %, or less than 4.0 wt %, or less than 3.0 wt %, or less than 2.0 wt %, or less than 1.0 wt %.

Naphthene content(s) and/or combined naphthene and aromatic content(s) can be determined, for example, using GCMS (gas chromatography—mass spectrometry). For GCMS measured values provided herein, approximately 50 milligram of a base stock sample was added to a standard 2 milliliter auto-sampler vial and diluted with methylene chloride solvent to fill the vial. Vials were sealed with septum caps. Samples were run using an Agilent 5975C GCMS (Gas Chromatograph Mass Spectrometer) equipped with an auto-sampler. A non-polar GC column was used to simulate distillation or carbon number elution characteristics off the GC. The GC column used was a Restek Rxi—1 ms. The column dimensions were 30 meters in length×0.32 mm internal diameter with a 0.25 micron film thickness for the stationary phase coating. The GC column was connected to the split/split-less injection port (held at 360° C. and operated in split-less mode) of the GC. Helium in constant pressure mode (~7 PSI) was used for GC carrier phase. The outlet of the GC column was run into mass spectrometer via a transfer line held at a 350° C. The temperature program for the GC column is a follows: 2 minute hold at 100° C., program at 5° C. per minute, 30 minute hold at 350° C. The mass spectrometer was operated using an electron impact ionization source (held at 250° C.) and operated using standard conditions (70 eV ionization). Instrumental control and mass spectral data acquisition were obtained using the Agilent Chemstation software. Mass calibration and instrument tuning performance validated using vendor supplied standard based on instrument auto tune feature.

GCMS retention times for samples were determined relative to a normal paraffin retention based on analysis of standard sample containing known normal paraffins. Then the mass spectrum was averaged. A group type analysis of for saturates fractions based on the characteristic fragment ions was performed. The group type analysis yielded the weight % of the following saturate and aromatic molecular types: total cycloparaffins and naphthenoaromatics, 1-6 ring cycloparaffinic species and naphthenoaromatic species, n-paraffins, monomethyl paraffins (i.e., MM paraffins), and dimethyl paraffins (i.e., DM paraffins). This procedure is similar to industry standard method ASTM D2786—Standard Test Method for Hydrocarbon Types Analysis of Gas-Oil Saturates Fractions by High Ionizing Voltage Mass Spectrometry.

In some aspects, a base stock as described herein can be used to formulate a lubricant composition that includes one or more additives and/or that includes a plurality of base stocks. When additives are included, the base stock(s) can constitute the major component of the engine or other mechanical component oil lubricant composition and typically can be present in an amount ranging from about 50 to about 99 weight percent, preferably from about 70 to about 95 weight percent, and more preferably from about 85 to about 95 weight percent, based on the total weight of the composition. As described herein, additives constitute the minor component of the engine or other mechanical component oil lubricant composition and typically can be present in an amount ranging from about less than 50 weight percent, preferably less than about 30 weight percent, and more preferably less than about 15 weight percent, based on the total weight of the composition. Mixtures of base stocks may be used if desired, for example, a base stock component and a cobase stock component. The cobase stock component can be present in an amount from about 1 to about 99 weight percent, preferably from about 5 to about 95 weight percent, and more preferably from about 10 to about 90 weight percent.

A formulated lubricating oil may contain one or more of the other commonly used lubricating oil performance additives including but not limited to antiwear additives, detergents, dispersants, viscosity modifiers, corrosion inhibitors, rust inhibitors, metal deactivators, extreme pressure additives, anti-seizure agents, wax modifiers, other viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see "Lubricant Additives, Chemistry and Applications", Ed. L. R. Rudnick, Marcel Dekker, Inc. 270 Madison Ave. New York, N.J. 10016, 2003, and Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil that may range from 5 weight percent to 50 weight percent.

In some aspects, the additives do not have to be soluble in the lubricating oils. Insoluble additives such as zinc stearate in oil can be dispersed in the lubricating oils of this disclosure.

When lubricating oil compositions contain one or more additives, the additive(s) are blended into the composition in an amount sufficient for it to perform its intended function. Additives are typically present in lubricating oil compositions as a minor component, typically in an amount of less than 50 weight percent, preferably less than about 30 weight percent, and more preferably less than about 15 weight percent, based on the total weight of the composition. Additives are most often added to lubricating oil compositions in an amount of at least 0.1 weight percent, preferably at least 1 weight percent, more preferably at least 5 weight percent. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the Table 1 below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The lube base stocks described herein are well suited as lube base stocks without blending limitations, and further, the lube base stock products are also compatible with lubricant additives for lubricant formulations. The lube base stocks can optionally be blended with other lube base stocks to form lubricants. Useful cobase lube stocks include Group I, III, IV and V base stocks and gas-to-liquid (GTL) oils. One or more of the cobase stocks may be blended into a lubricant composition including the lube base stock at from 0.1 to 50 wt. %, or 0.5 to 40 wt. %, 1 to 35 wt. %, or 2 to 30 wt. %, or 5 to 25 wt. %, or 10 to 20 wt. %, based on the total lubricant composition.

The lube base stocks and lubricant compositions can be employed in the present disclosure in a variety of lubricant-related end uses, such as a lubricant oil or grease for a device or apparatus requiring lubrication of moving and/or interacting mechanical parts, components, or surfaces. Useful apparatuses include engines and machines. The lube base stocks of the present disclosure are most suitable for use in the formulation of automotive crank case lubricants, automotive gear oils, transmission oils, many industrial lubricants including circulation lubricant, industrial gear lubricants, grease, compressor oil, pump oils, refrigeration lubricants, hydraulic lubricants, metal working fluids. Furthermore, the lube base stocks of this disclosure are derived from renewable sources; it is considered a sustainable product and can meet "sustainability" standards set by different industry groups or government regulations.

EXAMPLES

In Examples 1-4, an empirical model was used to determine model results for production of lubricant base stocks using a process involving raffinate hydroconversion. In the model system for Examples 1-4, a vacuum crude distillation unit was used as a fractionator to generate a feed fraction for production of a lubricant base stock having a desired viscosity. The initial feed to the vacuum crude distillation unit corresponded to a typical feed for lubricant base stock production. The feed fraction was then solvent extracted to produce a raffinate. The raffinate was hydroconverted by exposing the raffinate to a hydrotreatment catalyst under hydrotreatment conditions. The hydrotreatment catalyst for the model was a commercially available supported NiMo hydrotreating catalyst. A bottoms portion of the hydrotreated effluent was then dewaxed. The modeled dewaxing catalyst was 0.3 wt % Pt on ZSM-48. A bottoms portion of the dewaxed effluent was then hydrofinished. The modeled hydrofinishing catalyst was 0.15 wt % Pt and 0.45 wt % Pd on MCM-41. The model used to generate the model results in Examples 1-4 did not include the use of a sour hydrocracking reactor or a sweet hydrocracking reactor, but in some aspects a sour and/or sweet hydrocracker could be included as part of the process flow.

Example 1

Production of Group III Light Neutral Base Stock

Figure 2:
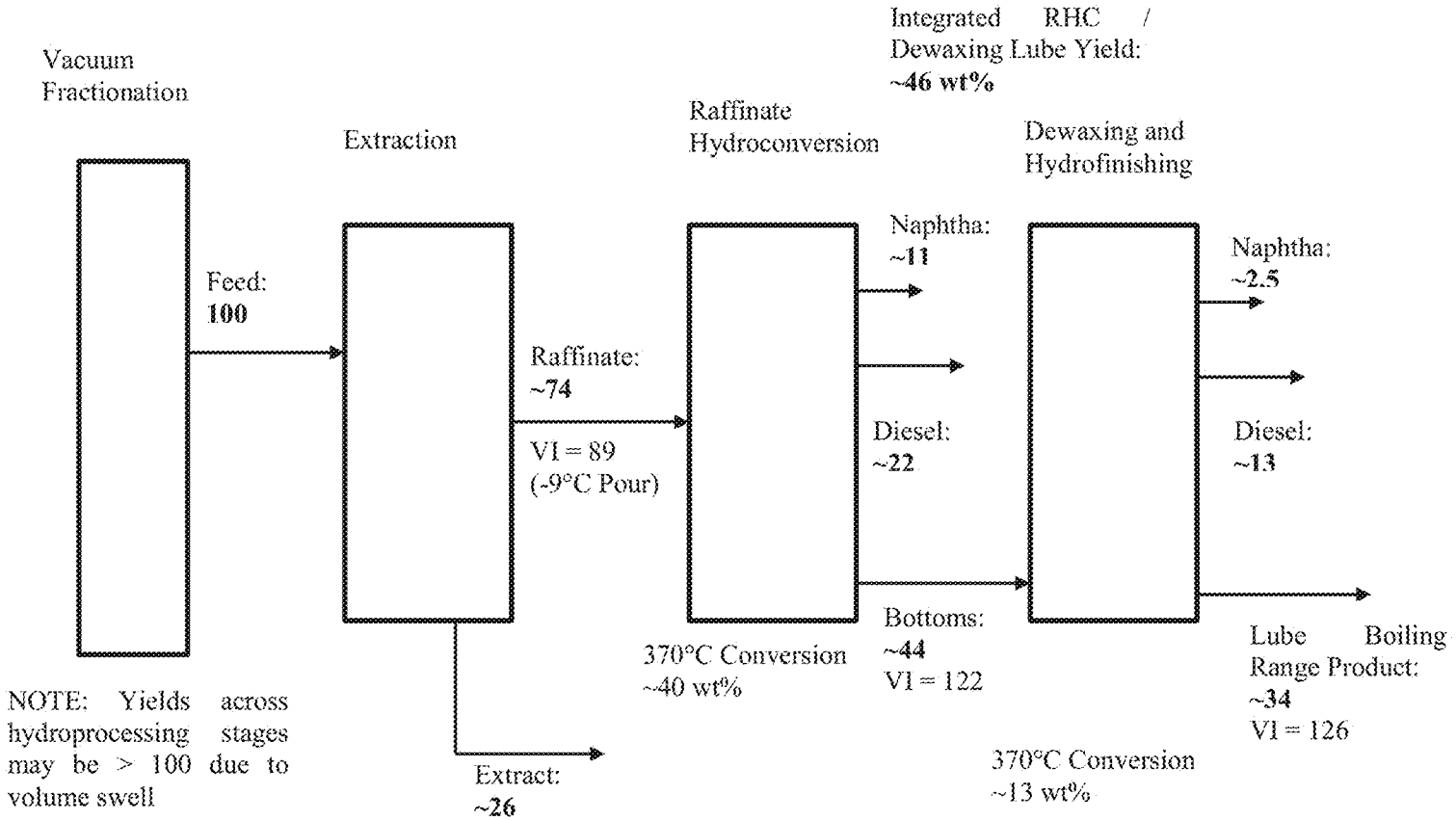
FIG. 2 shows an example of a process flow for producing a Group III base stock.

FIG. 2 shows a process flow and modeled values for production of a Group III light neutral base stock using raffinate hydroconversion. In the model corresponding to FIG. 2, a fraction suitable for forming a 130N base stock was withdrawn from the vacuum fractionator and passed into a solvent extraction unit. Based on the modeled solvent extraction conditions, the VI of the raffinate (solvent dewaxed to −18° C. pour point) was 89. The yield of raffinate was roughly 74 wt % relative to the amount of feed to the solvent extraction step. The raffinate was then hydrotreated under conditions suitable for conversion of 40 wt % of the raffinate relative to 370° C. This produced (after a separation) a 343° C.+ bottoms fraction with a modeled VI of roughly 122. This corresponds to a VI uplift of more than 30 based on hydrotreatment. Note that the net yield (relative to starting feed) of 44 wt % is shown in FIG. 2 for the 343° C.+ bottoms, as well as yields for naphtha and diesel boiling range products generated due to feed conversion. The hydrotreated bottoms was then catalytically dewaxed and hydrofinished at conditions suitable for producing a base stock with a pour point of −18° C. to −20° C. This resulted in roughly 13 wt % conversion of the hydrotreated bottoms. Again, the net yields for lubricant base stock, naphtha, and diesel boiling range fractions from dewaxing are also shown in FIG. 2. The lubricant base stock had a VI of 126, a pour point of −19° C., a kinematic viscosity at 100° C. of roughly 4.4 cSt, a kinematic viscosity at 40° C. of 20.3 cSt, a Noack volatility of 13.1 wt %, and a cold cranking simulator viscosity (ASTM D5293) of roughly 2900 cP. The net yield of the light neutral base stock relative to the amount of raffinate was roughly 46 wt %.

Example 2

Production of Group III Light Neutral Base Stock

Figure 3:
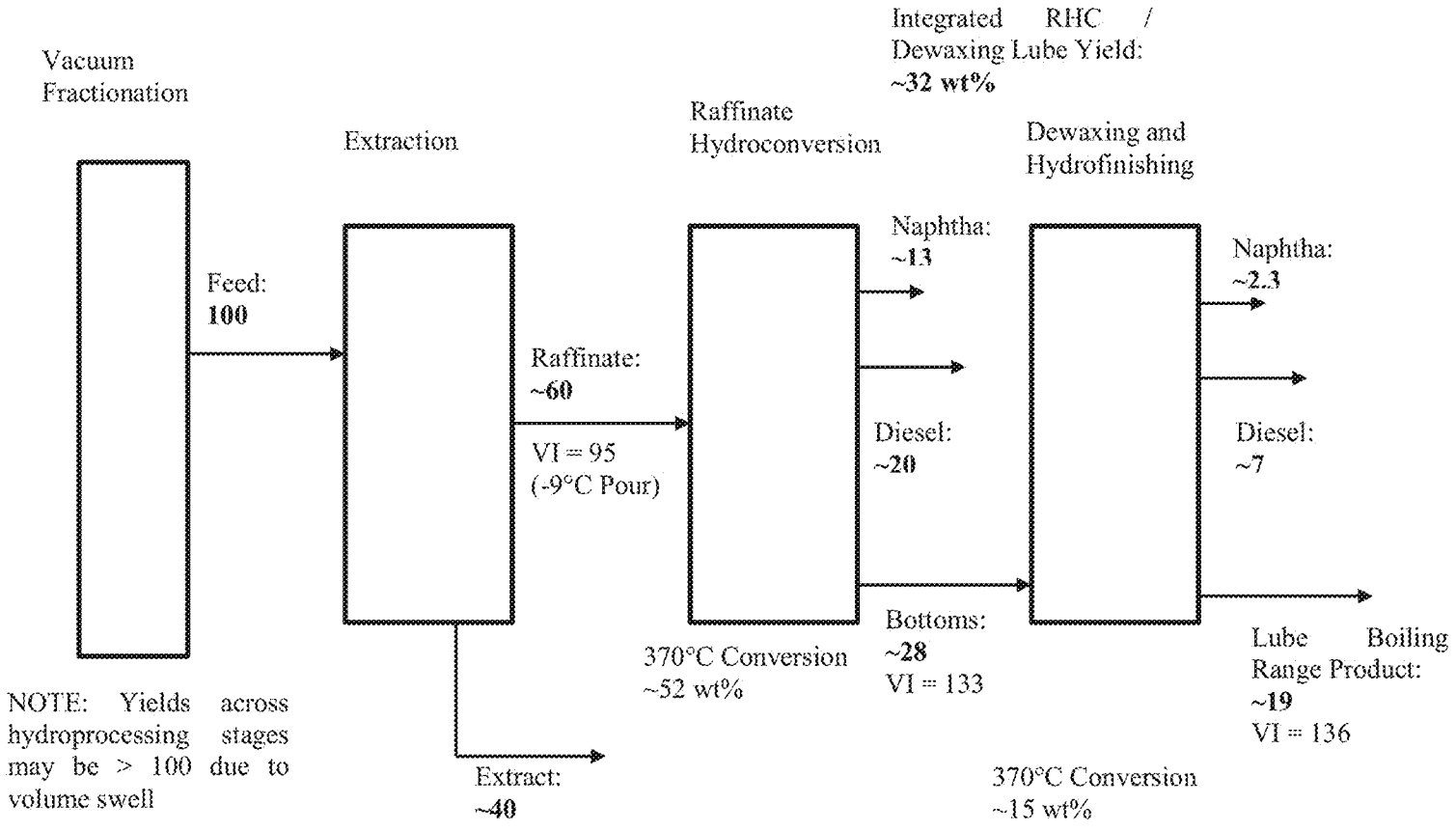
FIG. 3 shows an example of a process flow for producing a Group III base stock.

FIG. 3 shows a process flow and modeled values for production of a Group III light neutral base stock using raffinate hydroconversion. In the model corresponding to FIG. 3, a fraction suitable for forming a 130N base stock was withdrawn from the vacuum fractionator and passed into a solvent extraction unit. Based on the modeled solvent extraction conditions, the VI of the raffinate (solvent dewaxed to −18° C. pour point) was 95. The yield of raffinate was roughly 60 wt % relative to the amount of feed to the solvent extraction step. The raffinate was then hydrotreated under conditions suitable for conversion of 52 wt % of the feed relative to 370° C. This produced (after a separation) a 343° C.+ bottoms fraction with a modeled VI of roughly 133. This corresponds to a VI uplift of more than 30 based on hydrotreatment. Note that the net yield (relative to starting feed) of 28 wt % is shown in FIG. 3 for the 343° C.+ bottoms, as well as yields for naphtha and diesel boiling range products generated due to feed conversion. The hydrotreated bottoms was then catalytically dewaxed and hydrofinished at conditions suitable for producing a base stock with a pour point of −18° C. to −20° C. This resulted in roughly 15 wt % conversion of the hydrotreated bottoms. Again, the net yields for lubricant base stock, naphtha, and diesel boiling range fractions from dewaxing are also shown in FIG. 3. The lubricant base stock had a VI of 136, a pour point of −19° C., a kinematic viscosity at 100° C. of 4.2 cSt, a kinematic viscosity at 40° C. of 20.3 cSt, and a Noack volatility of 12.2 wt %. The net yield of the light neutral base stock relative to the amount of raffinate was roughly 32 wt %.

Example 3

Production of Group III Medium Neutral Base Stock

Figure 4:
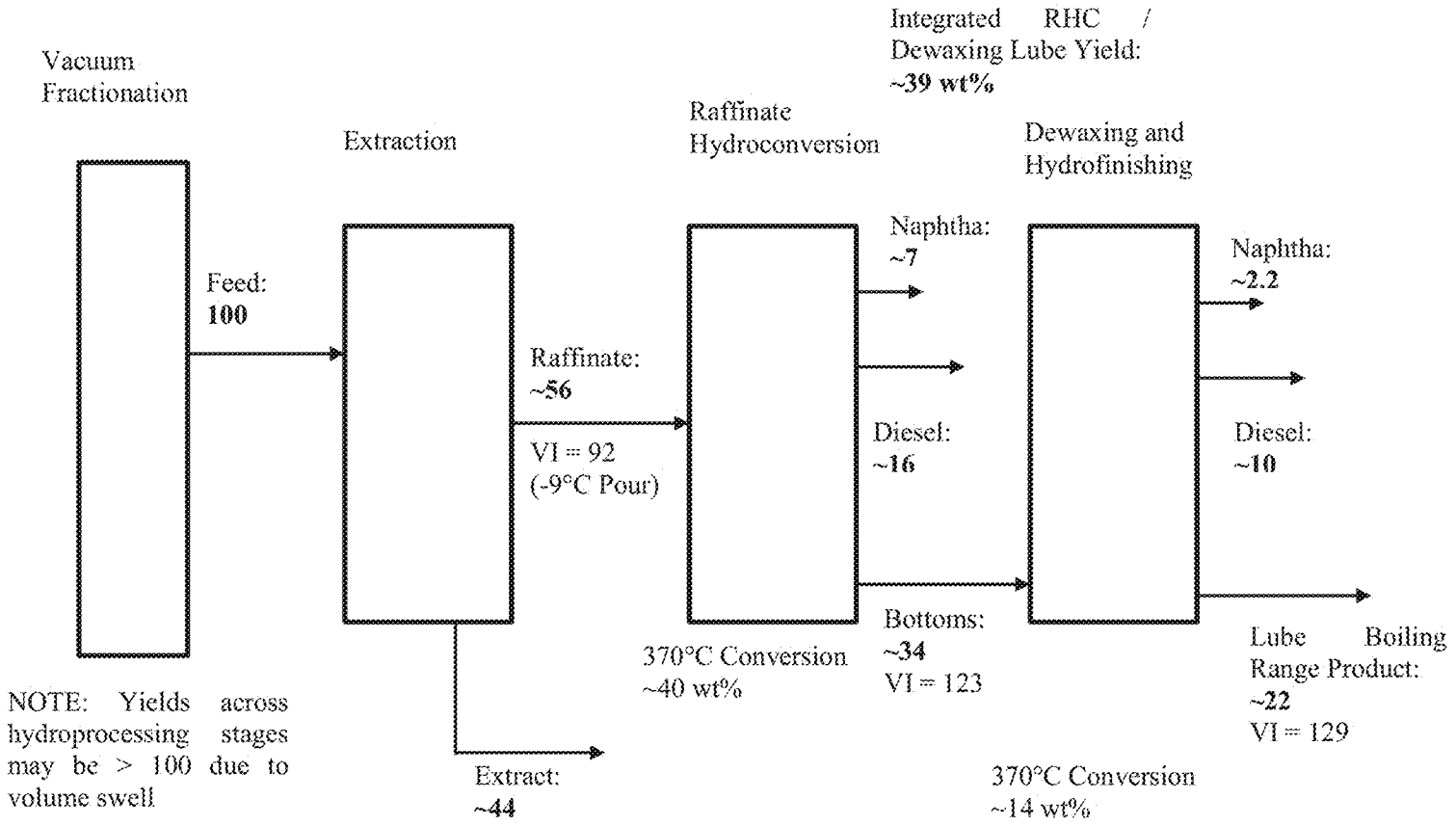
FIG. 4 shows an example of a process flow for producing a Group III base stock.

FIG. 4 shows a process flow and modeled values for production of a Group III medium neutral base stock using raffinate hydroconversion. In the model corresponding to FIG. 4, a fraction suitable for forming a 260N base stock was withdrawn from the vacuum fractionator and passed into a solvent extraction unit. Based on the modeled solvent extraction conditions, the VI of the raffinate (solvent dewaxed to −18° C. pour point) was 92. The yield of raffinate was roughly 56 wt % relative to the amount of feed to the solvent extraction step. The raffinate was then hydrotreated under conditions suitable for conversion of 40 wt % of the feed relative to 370° C. This produced (after a separation) a 343° C.+ bottoms fraction with a modeled VI of roughly 123. This corresponds to a VI uplift of more than 30 based on hydrotreatment. Note that the net yield (relative to starting feed) of 34 wt % is shown in FIG. 4 for the 343° C.+ bottoms, as well as yields for naphtha and diesel boiling range products generated due to feed conversion. The hydrotreated bottoms was then catalytically dewaxed and hydrofinished at conditions suitable for producing a base stock with a pour point of −18° C. to −20° C. This resulted in roughly 14 wt % conversion of the hydrotreated bottoms. Again, the net yields for lubricant base stock, naphtha, and diesel boiling range fractions from dewaxing are also shown in FIG. 4. The lubricant base stock had a VI of 129, a pour point of −19° C., a kinematic viscosity at 100° C. of 6.4 cSt, a kinematic viscosity at 40° C. of 36.2 cSt, and a Noack volatility of 5.0 wt %. The net yield of the medium neutral base stock relative to the amount of raffinate was roughly 39 wt %.

Example 4

Production of Group II Medium Neutral Base Stock

Figure 5:
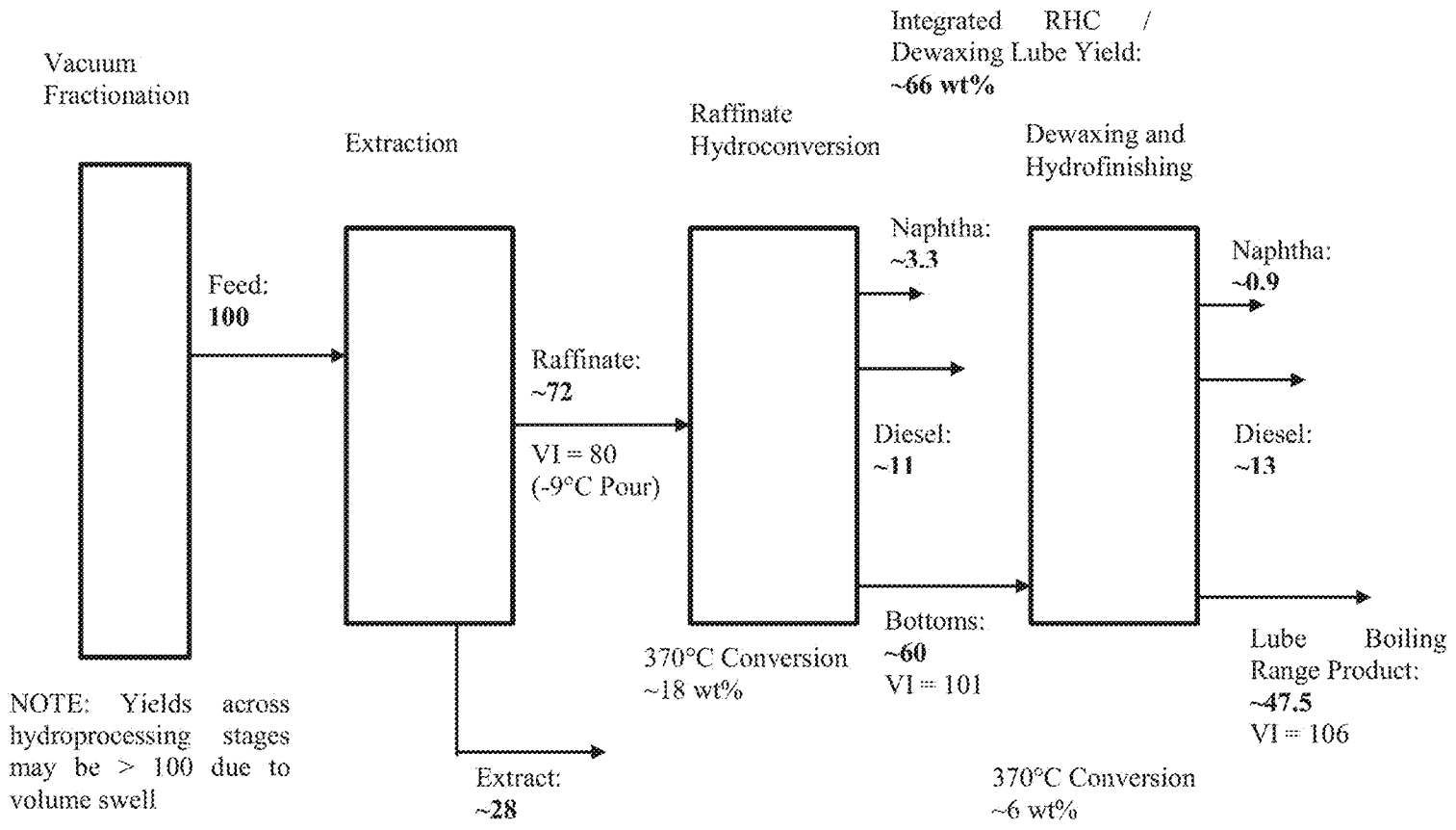
FIG. 5 shows an example of a process flow for producing a Group II base stock.

FIG. 5 shows a process flow and modeled values for production of a Group II heavy neutral base stock using raffinate hydroconversion. In the model corresponding to FIG. 5, a fraction suitable for forming a 600N base stock was withdrawn from the vacuum fractionator and passed into a solvent extraction unit. Based on the modeled solvent extraction conditions, the VI of the raffinate (solvent dewaxed to −18° C. pour point) was 80. The yield of raffinate was roughly 72 wt % relative to the amount of feed to the solvent extraction step. The raffinate was then hydrotreated under conditions suitable for conversion of 18 wt % of the feed relative to 370° C. This produced (after a separation) a 343° C.+ bottoms fraction with a modeled VI of roughly 101. This corresponds to a VI uplift of more than 20 based on hydrotreatment. Note that the net yield (relative to starting feed) of 60 wt % is shown in FIG. 5 for the 343° C.+ bottoms, as well as yields for naphtha and diesel boiling range products generated due to feed conversion. The hydrotreated bottoms was then catalytically dewaxed and hydrofinished at conditions suitable for producing a base stock with a pour point of −15° C. to −17° C. This resulted in roughly 6 wt % conversion of the hydrotreated bottoms. Again, the net yields for lubricant base stock, naphtha, and diesel boiling range fractions from dewaxing are also shown in FIG. 5. The lubricant base stock had a VI of 106, a pour point of −16° C., a kinematic viscosity at 100° C. of 11.9 cSt, a kinematic viscosity at 40° C. of 102.1 cSt, and a Noack volatility of 2.0 wt %. The net yield of the heavy neutral base stock relative to the amount of raffinate was roughly 66 wt %.

Additional Embodiments

Embodiment 1. A method for making a base stock, comprising: performing solvent extraction on a feedstock to form a raffinate comprising a solvent dewaxed viscosity index (VI) of 80 to 105 at a pour point of −18° C.; hydroconverting at least a portion of the raffinate under hydroconversion conditions to form a hydroconverted effluent, the hydroconversion conditions being effective for conversion of at least 15 wt % of the at least a portion of the raffinate relative to a conversion temperature of 370° C., the hydroconverted effluent comprising a VI at least 20 greater than the solvent dewaxed VI of the raffinate, a 343° C.+ portion of the hydroconverted effluent comprising a sulfur content of 50 wppm or less; separating at least a portion of the hydroconverted effluent to form at least a lower boiling fraction (such as a fuels boiling range fraction) and a lubricant boiling range fraction having a T10 distillation point of at least 343° C.; dewaxing at least a portion of the lubricant boiling range fraction under catalytic dewaxing conditions to form a dewaxed effluent; and fractionating at least a portion of the dewaxed effluent to form a base stock comprising a viscosity index of greater than 120, a sulfur content of less than 300 wppm (or less than 50 wppm), and a saturates content of at least 90 wt %.

Embodiment 2. The method of Embodiment 1, wherein the method further comprises a) hydrofinishing the at least a portion of the lubricant boiling range fraction prior to the dewaxing; b) hydrofinishing the at least a portion of the dewaxed effluent prior to the fractionating; or c) a combination of a) and b).

Embodiment 3. The method of any of the above embodiments, wherein the base stock comprises a viscosity index of at least 125, or at least 130, or at least 135; or wherein the hydroconverted effluent comprises a VI at least 30 greater than the solvent dewaxed VI at a pour point of −18° C. of the raffinate, or at least 40 greater; or a combination thereof Embodiment 4. The method of any of the above embodiments, wherein the hydroconversion conditions are effective for conversion of 30 wt % to 60 wt % of the feed relative to a conversion temperature of 370° C., or 40 wt % to 60 wt %, or 50 wt % to 60 wt %; or wherein the catalytic dewaxing conditions are effective for conversion of at least 10 wt % of the lubricant boiling range fraction relative to a conversion temperature of 370° C.; or a combination thereof.

Embodiment 5. The method of any of the above embodiments, wherein the Noack volatility of the base stock is 15 wt % or less, or 13 wt % or less, or 10 wt % or less, or 5 wt % or less.

Embodiment 6. The method of any of the above embodiments, wherein the base stock comprises a kinematic viscosity of 3.0 cSt to 8.0 cSt, or 3.5 cSt to 7.5 cSt; or wherein the base stock comprises a kinematic viscosity at 100° C. of 4.5 cSt to 8.0 cSt, or 5.0 cSt to 7.5 cSt, or 5.5 cSt to 7.5 cSt; or wherein the base stock comprises a kinematic viscosity at 100° C. of 3.0 cSt to 4.5 cSt, or 3.5 cSt to 4.5 cSt.

Embodiment 7. The method of any of the above embodiments, wherein the base stock comprises a Group III base stock or a Group III+ base stock; or wherein the feedstock comprises at least 50 wt % of a mineral feedstock, or at least 75 wt %, or at least 95 wt %; or a combination thereof.

Embodiment 8. The method of any of the above embodiments, wherein hydroconverting the at least a portion of the raffinate comprises hydrotreating the at least a portion of the raffinate under hydrotreating conditions, the hydroconverted effluent comprising a hydrotreated effluent, and optionally wherein separating the at least a portion of the hydroconverted effluent comprises separating at least a portion of the hydrotreated effluent, the at least a portion of the hydrotreated effluent being separated prior to further hydroprocessing; or wherein hydroconverting the at least a portion of the raffinate comprises hydrocracking the at least a portion of the raffinate under hydrocracking conditions; or a combination thereof.

Embodiment 9. The method of any of the above embodiments, wherein dewaxing at least a portion of the lubricant boiling range fraction comprises: hydrocracking at least a second portion of the lubricant boiling range fraction under sweet hydrocracking conditions to form a sweet hydrocracked effluent; and dewaxing at least a portion of the sweet hydrocracked effluent.

Embodiment 10. A base stock comprising a viscosity index (VI) of at least 130 (or at least 135), a sulfur content of 50 wppm or less, a saturates content of at least 90 wt %, a Noack volatility of 14 wt % or less, a pour point of −15° C. or less, and a kinematic viscosity at 100° C. of 3.5 to 4.5 cSt, the base stock further comprising a 3+ ring naphthene content of 1.0 wt % or less.

Embodiment 11. A base stock comprising a viscosity index (VI) of at least 125 (or at least 130 or at least 135), a sulfur content of 50 wppm or less, a saturates content of at least 90 wt %, a Noack volatility of 5 wt % or less, a pour point of −15° C. or less, and a kinematic viscosity at 100° C. of 4.5 to 8.0 cSt (or 5.0 cSt to 7.5 cSt, or 5.5 cSt to 7.5 cSt), the lubricant base stock further comprising a 3+ ring naphthene content of 4.0 wt % or less, or 2.0 wt % or less, or 1.0 wt % or less.

Embodiment 12. The base stock of Embodiment 10 or 11, wherein the 3+ ring aromatic content is 0.5 wt % or less, or 0.2 wt % or less, or a combination thereof.

Embodiment 13. The base stock of any of Embodiments 10 to 12, wherein the base stock is derived from a feedstock that comprises at least 50 wt % of a mineral feedstock, or at least 75 wt %, or at least 95 wt %; or wherein the base stock comprises a Group III base stock or a Group III+ base stock; or a combination thereof.

Embodiment 14. A lubricant composition comprising the base stock of any of Embodiments 10 to 13, the lubricant composition further comprising a) at least 5 wt % of a base stock having a kinematic viscosity at 100° C. of 4.5 cSt to 8.0 cSt; or b) at least 5 wt % of a base stock having a kinematic viscosity at 100° C. of 3.0 cSt to 4.5 cSt.

Embodiment 15. The lubricant composition of Embodiment 14, further comprising an additive, a second base stock, or a combination thereof, wherein optionally i) the second base stock comprises a polyalphaolefin base stock, a Fischer-Tropsch base stock, a Group I base stock, a Group II base stock, a Group III base stock, or a combination thereof; ii) the additive comprises a finished lubricant base stock additive; iii) the lubricant composition comprises at least 75 wt % of the first base stock, or at least 95 wt %; iv) the first base stock is derived from a mineral feedstock; v) the additive is selected from antiwear additives, detergents, dispersants, viscosity modifiers, corrosion inhibitors, rust inhibitors, metal deactivators, extreme pressure additives, anti-seizure agents, wax modifiers, other viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, or combinations thereof; or vi) a combination thereof of two or more of i)-v).

Supplemental Embodiment. A base stock produced according to the method of any of Embodiments 1-9.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A method for making a base stock, comprising:

performing solvent extraction on a feedstock to form a raffinate comprising a solvent dewaxed viscosity index (VI) of 80 to 105 at a pour point of −18° C., the feedstock comprising at least 50 wt % of a mineral feedstock;

hydroconverting at least a portion of the raffinate under hydroconversion conditions to form a hydroconverted effluent, the hydroconversion conditions being effective for conversion of at least 15 wt % of the at least a portion of the raffinate relative to a conversion temperature of 370° C., the hydroconverted effluent comprising a VI at least 20 greater than the solvent dewaxed VI of the raffinate, a 343° C.+ portion of the hydroconverted effluent comprising a sulfur content of 50 wppm or less;

separating at least a portion of the hydroconverted effluent to form at least a lower boiling fraction and a lubricant boiling range fraction having a T10 distillation point of at least 343° C.;

dewaxing at least a portion of the lubricant boiling range fraction under catalytic dewaxing conditions to form a dewaxed effluent; and fractionating at least a portion of the dewaxed effluent to form a base stock comprising a viscosity index of greater than 120, a sulfur content of less than 300 wppm, and a saturates content of at least 90 wt %.

2. The method of claim 1, wherein the method further comprises a) hydrofinishing the at least a portion of the lubricant boiling range fraction prior to the dewaxing; b) hydrofinishing the at least a portion of the dewaxed effluent prior to the fractionating; or c) a combination of a) and b).

3. The method of claim 1, wherein the base stock comprises a viscosity index of at least 130.

4. The method of claim 1, wherein the hydroconverted effluent comprises a VI at least 30 greater than the solvent dewaxed VI at a pour point of −18° C. of the raffinate.

5. The method of claim 1, wherein the hydroconversion conditions are effective for conversion of 30 wt % to 60 wt % of the feed relative to a conversion temperature of 370° C.

6. The method of claim 1, wherein the Noack volatility of the base stock is 15 wt % or less.

7. The method of claim 1, wherein the catalytic dewaxing conditions are effective for conversion of at least 10 wt % of the lubricant boiling range fraction relative to a conversion temperature of 370° C.

8. The method of claim 1, wherein the base stock comprises a kinematic viscosity at 100° C. of 3.0 cSt to 8.0 cSt.

9. The method of claim 1, wherein the base stock comprises a kinematic viscosity at 100° C. of 4.5 cSt to 8.0 cSt.

10. The method of claim 1, wherein the base stock comprises a kinematic viscosity at 100° C. of 3.0 cSt to 4.5 cSt.

11. The method of claim 1, wherein the base stock comprises a Group III base stock.

12. The method of claim 1, wherein the base stock comprises a Group III+ base stock.

13. The method of claim 1, wherein hydroconverting the at least a portion of the raffinate comprises hydrotreating the at least a portion of the raffinate under hydrotreating conditions, the hydroconverted effluent comprising a hydrotreated effluent.

14. The method of claim 13, wherein separating the at least a portion of the hydroconverted effluent comprises separating at least a portion of the hydrotreated effluent, the at least a portion of the hydrotreated effluent being separated prior to further hydroprocessing.

15. The method of claim 1, wherein dewaxing at least a portion of the lubricant boiling range fraction comprises:

hydrocracking at least a second portion of the lubricant boiling range fraction under sweet hydrocracking conditions to form a sweet hydrocracked effluent; and dewaxing at least a portion of the sweet hydrocracked effluent.

16. A method for making a base stock, comprising:

performing solvent extraction on a feedstock to form a raffinate comprising a solvent dewaxed viscosity index (VI) of 80 to 105 at a pour point of −18° C.;

hydroconverting at least a portion of the raffinate under hydroconversion conditions to form a hydroconverted effluent, the hydroconversion conditions being effective for conversion of at least 15 wt % of the at least a portion of the raffinate relative to a conversion temperature of 370° C., the hydroconverted effluent comprising a VI at least 20 greater than the solvent dewaxed VI of the raffinate, a 343° C.+ portion of the hydroconverted effluent comprising a sulfur content of 50 wppm or less;

separating at least a portion of the hydroconverted effluent to form at least a lower boiling fraction and a lubricant boiling range fraction having a T10 distillation point of at least 343° C.;

dewaxing at least a portion of the lubricant boiling range fraction under catalytic dewaxing conditions to form a dewaxed effluent, wherein dewaxing at least a portion of the lubricant boiling range fraction comprises:

hydrocracking at least a second portion of the lubricant boiling range fraction under sweet hydrocracking conditions to form a sweet hydrocracked effluent; and dewaxing at least a portion of the sweet hydrocracked effluent; and fractionating at least a portion of the dewaxed effluent to form a base stock comprising a viscosity index of greater than 120, a sulfur content of less than 300 wppm, and a saturates content of at least 90 wt %.

17. The method of claim 16, wherein the method further comprises a) hydrofinishing the at least a portion of the lubricant boiling range fraction prior to the dewaxing; b) hydrofinishing the at least a portion of the dewaxed effluent prior to the fractionating; or c) a combination of a) and b).

18. The method of claim 16, wherein the base stock comprises a viscosity index of at least 130.

19. The method of claim 16, wherein the hydroconverted effluent comprises a VI at least 30 greater than the solvent dewaxed VI at a pour point of −18° C. of the raffinate.

20. The method of claim 16, wherein the hydroconversion conditions are effective for conversion of 30 wt % to 60 wt % of the feed relative to a conversion temperature of 370° C.

21. The method of claim 16, wherein the Noack volatility of the base stock is 15 wt % or less.

22. The method of claim 16, wherein the catalytic dewaxing conditions are effective for conversion of at least 10 wt % of the lubricant boiling range fraction relative to a conversion temperature of 370° C.

23. The method of claim 16, wherein the base stock comprises a kinematic viscosity at 100° C. of 3.0 cSt to 8.0 cSt.

24. The method of claim 16, wherein the base stock comprises a kinematic viscosity at 100° C. of 4.5 cSt to 8.0 cSt.

25. The method of claim 16, wherein the base stock comprises a kinematic viscosity at 100° C. of 3.0 cSt to 4.5 cSt.

26. The method of claim 16, wherein the base stock comprises a Group III base stock.

27. The method of claim 16, wherein the base stock comprises a Group III+ base stock.

28. The method of claim 16, wherein hydroconverting the at least a portion of the raffinate comprises hydrotreating the at least a portion of the raffinate under hydrotreating conditions, the hydroconverted effluent comprising a hydrotreated effluent.

29. The method of claim 28, wherein separating the at least a portion of the hydroconverted effluent comprises separating at least a portion of the hydrotreated effluent, the at least a portion of the hydrotreated effluent being separated prior to further hydroprocessing.

30. The method of claim 16, wherein the feedstock comprises at least 50 wt % of a mineral feedstock.

* * * * *